United States Patent [19]

Schönwald et al.

[11] 4,363,598

[45] Dec. 14, 1982

[54] MULTISTAGE SIDE-CHANNEL COMPRESSOR

[75] Inventors: Siegfried Schönwald, Bad Neustadt; Gert Hecht, Bremen, both of Fed. Rep. of Germany

[73] Assignee: Siemens Aktiengesellschaft, Munich, Fed. Rep. of Germany

[21] Appl. No.: 157,891

[22] Filed: Jun. 9, 1980

Related U.S. Application Data

[63] Continuation of Ser. No. 896,232, Apr. 13, 1978, abandoned.

[30] Foreign Application Priority Data

May 11, 1977 [DE] Fed. Rep. of Germany ... 7715000[U]

[51] Int. Cl.[3] ..... F04D 5/00

[52] U.S. Cl. ..... 415/53 T; 415/177; 415/213 T

[58] Field of Search ..... 415/53 T, 198.2, 213 T, 415/177

[56] References Cited

U.S. PATENT DOCUMENTS

| | | | |
|---|---|---|---|
| 2,509,555 | 5/1950 | Youhouse | 60/39.34 |
| 3,135,215 | 6/1964 | Smith | 415/198.2 |
| 3,336,876 | 8/1967 | Streuli | 415/213 T |
| 3,915,589 | 10/1975 | Linden | 415/213 T |

*Primary Examiner*—Louis J. Casaregola

*Attorney, Agent, or Firm*—Kenyon & Kenyon

[57] ABSTRACT

A multistage side-channel compressor including a plurality of housings for the individual compressor stages. Each of the housings consists of a pair of housing halves and are disposed axially one behind the other and are connected to each other. The improvement of the invention comprises the provision of a plurality of circumferential, radially outwardly extending cooling fins on the outer surface of each of the housing halves of the compressor disposed axially inwardly between the housing halves disposed axially outermost at the ends of the compressor.

1 Claim, 1 Drawing Figure

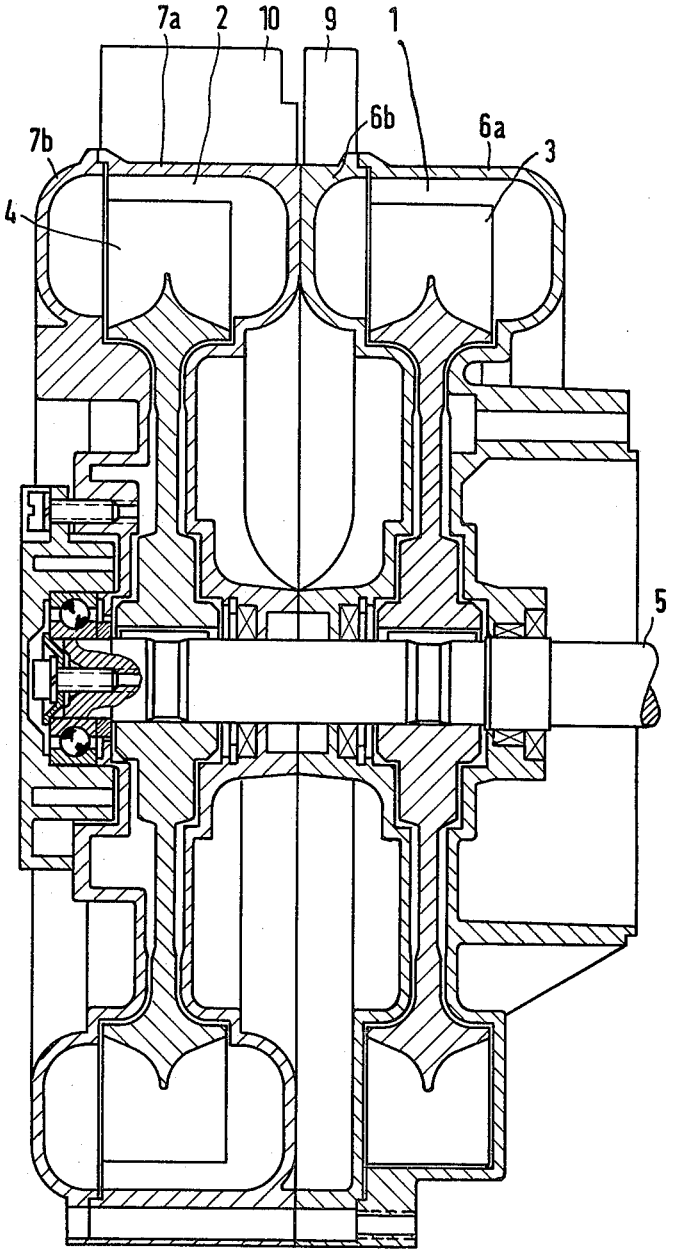
7a
2
10
9
1
6b
6a
7b
3
4
5

MULTISTAGE SIDE-CHANNEL COMPRESSOR

This is a continuation, of application Ser. No. 896,232 filed Apr. 13, 1978 (abandoned).

BACKGROUND OF THE INVENTION

1. Field of the Invention

This invention relates to a multistage side-channel compressor including a plurality of housings for the individual compressor stages of the compressor which each consist of a pair of housing halves and are disposed axially one behind the other and are connected to each other.

2. Description of the Prior Art

Multistage side-channel compressors of the foregoing type are known in the art. See, for example, U.S. Pat. No. 3,545,890. A separate cooling system is included in this known side-channel compressor between the housing of the two compressor stages for discharging heat produced by the compression effected in the compressor. This cooling system consists of a blower which blows cooling air through baffles connected to the housings of the compressor.

The disadvantage of this compressor is that the cooling system requires considerable effort for assembly since even if the baffles are fabricated in a single piece with the corresponding housing parts, the blower must still be mounted between the two housings of the compressor.

SUMMARY OF THE INVENTION

It is therefore an object of the present invention to overcome the aforementioned disadvantages of heretofore known side-channel compressors and to provide an improved multistage side-channel compressor in which sufficient cooling is achieved without the need for a separately-mountable cooling device.

These and other objects of the invention are achieved in a multistage side-channel compressor including a plurality of housings for the individual compressor stages of the compressor. The housings each consist of a pair of housing halves and are disposed axially one behind the other and are connected to each other. The improvement comprises each of the housing halves of the compressor disposed axially inwardly between the housing halves disposed axially outermost at the ends of the compressor having a plurality of circumferential, radially outwardly extending cooling fins disposed on the outer surfaces thereof.

The cooling fins provided on the axially inner housing halves are formed on those halves at the time the corresponding housing halves are fabricated. There is, thus, no additional expense for manufacturing the cooling fins separately nor is there additional expense for the later assembly of the side-channel compressor. In addition, the axially outer housing halves can be used for both multistage and single stage side-channel compressors, thereby permitting efficient production.

These and other novel features and advantages of the invention will be described in greater detail in the following detailed description.

BRIEF DESCRIPTION OF THE DRAWING

The drawing is a cross-sectional view of an improved multistage side-channel compressor constructed according to the present invention.

DETAILED DESCRIPTION

Referring now to the drawings, there is shown two compression stages 1 and 2 of a two-stage side-channel compressor. Each compressor stage has an impeller 3 and 4, respectively, mounted on a common shaft 5. This latter shaft may comprise the free end of a drive motor shaft. Each of the compression stages 1 and 2 includes a housing consisting of two housing halves, *6a*, *6b* and *7a*, *7b*, respectively. The axially inner housing halves *6b* and *7a* are disposed between the axially outermost housing halves *6a* and *7b* and have a plurality of circumferential, radially outwardly extending cooling fins 9 and 10 disposed on the outer surfaces thereof.

Radial cooling fins 9 and 10 disposed on inner housing halves *6b* and *7a* are designed to meet the cooling area requirements of the compressor, which are greater in a multistage compressor. These cooling fins are formed on the housing halves at the time housing halves *6b* and *7a* are fabricated. Accordingly, no additional expense is incurred during manufacturing or during the later assembly of the housing halves in the compressor. Since the radial cooling fins 9 and 10 are also provided only on the inner housing halves *6b* and *7a* disposed between the axially outermost housing halves *6a* and *7b* at the ends of the compressor, a side-channel compressor with the smallest possible dimensions is obtained for a single-stage compressor design in which housing half *7b* would be assembled to housing half *6a*.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A multistage side channel compressor comprising:

an input stage having an input and an output, and an output stage axially coupled to the input stage, the output stage having an input which is coupled to the output of input stage and an output, in which:

each stage comprises a first housing half and a second housing half, each housing half having a circumference, and the first housing half of the input stage and the second housing half of the output stage comprise a compact housing for a single stage compressor and are without cooling fins on their circumferences, and further comprising:

a first plurality of radially outward extending cooling fins on the circumference of the second housing half of the input stage; and a second plurality of radially outward extending cooling fins on the circumference of the first housing half of the output stage.

* * * * *